US008461076B2

(12) United States Patent
Okada et al.

(10) Patent No.: US 8,461,076 B2
(45) Date of Patent: Jun. 11, 2013

(54) THERMOSENSITIVE RECORDING MEDIUM

(75) Inventors: Shinji Okada, Shizuoka (JP); Kenji Shimizu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 13/041,887

(22) Filed: Mar. 7, 2011

(65) Prior Publication Data

US 2011/0224074 A1 Sep. 15, 2011

(30) Foreign Application Priority Data

Mar. 11, 2010 (JP) ..... 2010-054332

(51) Int. Cl.
*B41M 5/42* (2006.01)

(52) U.S. Cl.
USPC ..... 503/226

(58) Field of Classification Search
None
See application file for complete search history.

(56) References Cited

U.S. PATENT DOCUMENTS

| | | | |
|---|---|---|---|
| 2008/0182749 | A1 | 7/2008 | Tohmatsu et al. |
| 2009/0215622 | A1 | 8/2009 | Okada et al. |

FOREIGN PATENT DOCUMENTS

| | | |
|---|---|---|
| JP | 5-177943 | 7/1993 |
| JP | 7-23025 | 3/1995 |
| JP | 7-81227 | 3/1995 |
| JP | 11-240251 | 9/1999 |
| JP | 2001-180132 | 7/2001 |
| JP | 2004-107474 | 4/2004 |
| JP | 2005-23263 | 1/2005 |
| JP | 2005-28764 | 2/2005 |
| JP | 3646815 | 2/2005 |
| JP | 2008-73858 | 4/2008 |
| JP | 4410672 | 11/2009 |

*Primary Examiner* — Bruce H Hess
(74) *Attorney, Agent, or Firm* — Cooper & Dunham LLP

(57) ABSTRACT

To provide a thermosensitive recording medium, containing: a support; a thermosensitive recording layer; and a surface layer, where the thermosensitive recording layer and the surface layer are provided over the support, wherein the thermosensitive recording layer contains a binding agent, a coloring agent, and a color developer, and wherein the surface layer contains polyester (meth)acrylate having at least three (meth)acryloyl groups, and an α-hydroxyketone-based polymerization initiator having a melting point of 80° C. or higher.

13 Claims, No Drawings

THERMOSENSITIVE RECORDING MEDIUM

BACKGROUND OF THE INVENTION

1. Field of the Invention

The present invention relates to a thermosensitive recording medium that uses a coloring reaction between an electron-donating coloring compound and an electron-accepting compound, and the like, and that has a high image quality, glossiness, high density, and high tone, all of which are at the same level as those of silver halide photographic films, and thus that is particularly suitable for a medical image forming sheet for diagnosing or observing images of X-ray, MRI or CT.

2. Description of the Related Art

Thermosensitive recording media have been widely known in the art. Such thermosensitive recording medium has a thermosensitive recording layer provided on a support such as paper, and the thermosensitive recording layer contains an electron-donating coloring compound (also referred to as a coloring agent, hereinafter) and an electron-accepting compound (also referred to as a color developer, hereinafter). The thermosensitive recording medium utilizes a coloring reaction between the coloring agent and the color developer. This recording system has advantages such that a recording machine is compact and inexpensive, and maintenance thereof is easy. For this reasons, this recording system has been applied in the various fields, such as for facsimiles, ticket venders, printers for scientific measurements, printers for printing POS barcodes, and printers for CRT-based medical measurements.

In this recording medium, however, heat is directly applied from a thermal head to head a thermosensitive recording medium for recording. Therefore, various inventions have been made for a surface layer (generally called as an over layer or a protective layer) of the thermosensitive recording layer, which is brought into a direct contact with a thermal head. Various surface layers whose resin, lubricant, filler, and the like are developed have been proposed as inventions.

For using a thermosensitive recording medium in a medical working site, a surface of the thermosensitive recording medium is required to have high barrier properties to water or alcohol, as it is highly possible that the thermosensitive recording medium comes to in contact with water, alcohol or other solvents. It has been proposed that high barrier properties and glossiness are provided by using an electron-beam or ultraviolet curing resin, or water-soluble resin, core-shell emulsion containing a water-insoluble emulsion, and a crosslinking agent in combination.

However, in recent year, recordings of high speed and high accuracy have been demanded, and to meet the demand there has been a trend that electricity applied to each element of a thermal head is increased.

Moreover, a thermosensitive recording medium of medical use is used for diagnosis or references, and thus a subject for recording is mainly structural information or shape information, such as internal organs or bones of human bodies. It is important that the recognized image accurately reflects the original shape information, and images of deep blackness, high gradation, high glossiness, excellent concentration difference and contrast are expected.

Therefore, the higher gradation of images are required, and thus the higher output recording is required for thermosensitive recording media of medical use among all types of thermosensitive recording media including conventional leuco-type thermosensitive recording media. For such high output recording, a surface layer of a thermosensitive recording layer, having high heat resistance endurable with heat of a thermal head, as well as excellent glossiness, is desired.

Generally, to achieve head matching properties, it has been a common practice to increase proportions of filler and a lubricant to be added, as well as improving heat resistance of a resin.

However, use of the filler or lubricant reduces the surface glossiness of the resulting thermosensitive recording medium. Therefore, it has been proposed to reduce particle diameters of the filler or lubricant, or to reduce amounts of the filler or lubricant for use (see Japanese Patent Laid-Open (JP-A) No. 2008-73858, and Japanese Patent Application Publication (JP-B) No. 07-023025).

However, these methods reduce the heat resistance or lubricity of the film. The provided media by these proposal may have an effect for sticking, when they are used with high output thermal head in the recent medical recording, but sticking is only concerned when high energy is out put per image. The inventions proposed so far have not satisfies all of the various strict demands for practical use, such as prevention of depositions to a heating member occurred during continuous recording, high glossiness, water resistance, and solvent resistance. Therefore, further developments of thermosensitive recording media have been desired.

To reduce the amounts of the filler or lubricant, numbers of the inventions using, as a resin having extremely high heat resistance, a radiation-curing resin, such as an electron beam curing resin, and ultraviolet-curing resin have been made.

The electron beam curing resin is cured by irradiation of electron beams. Therefore, it is hardly affected by filler or additives, and desirable curing ability can be easily attained. However, it is difficult to control irradiation of electron beams because the thermosensitive recording layer may be colored by electron beams, or the support may be destroyed by electron beams. Moreover, there is also a problem that a large scale of a device is required (see JP-A No. 05-177943).

In contrast, in the case of ultraviolet irradiation, a device for use is simple, and ultraviolet rays do not destroy the support or color the thermosensitive recording layer, as long as cooling is performed to the support. However, there is a problem that yellowing of the thermosensitive recording layer occurs due to ultraviolet rays.

Particularly for the intended use in which excellent color tone of an image is required including whiteness of back ground and half-tone, yellowing of the back ground or half-tone is the problem to be solved.

Moreover, in the case where heat resistance of a radiation curing resin is attempted to be improved, curling of a thermosensitive recording medium tends to occur due to shrinkage on curing or distortion of the film. Since such thermosensitive recording medium is less flexible, problems, such as cracking, are caused by handling or under low temperature environment. Particularly, this is a problematic for the intended use in which the thermosensitive recording medium is handled in the form of a sheet (see JP-A No. 05-177943, Japanese Patent (JP-B) No. 3646815, and JP-A No. 07-81227). Note that, JP-B No. 3646815 discloses a reversible thermosensitive recording medium containing a reversible thermosensitive recording layer which is reversibly and repetitively changed from a transparent condition to a cloud condition by heating. The thermosensitive recording medium of the present invention concerns heat resistance thereof, and not the technology limited to thermosensitive (once) or reversible (rewrite), and therefore JP-B No. 3646815 is listed as a related art because it discloses the invention to solve the similar problem.

BRIEF SUMMARY OF THE INVENTION

The present invention relates to a thermosensitive recording medium which uses a coloring reaction between an electron-donating coloring compound and an electron-accepting compound, and an object of the present invention is to provide a reflective thermosensitive recording medium, which maintains its high glossiness, causes no image failure due to the deposition of head dusts, nor sticking during printing, has excellent color tones of a background and an image, causes no curling or charging, causes no problem of handling due to odor, and is suitably for medical use.

The present inventors diligently studied to find a means for achieving both high glossiness and desirable head matching, both of which are usually in the relationship of trade-off, as well as satisfying the prevention of yellowing of a background, and curing, and desirable charging ability. As a result, they found that the aforementioned problems in the art could be solved with a thermosensitive recording medium containing a thermosensitive recording layer and a surface layer on a support, by adding polyester (meth)acrylate having at least three (meth)acryloyl groups and α-hydroxyphenylketone-based polymerization initiator having a melting point of 80° C. or higher to the surface layer.

The present invention is based upon the aforementioned findings of the present inventors, and the means for solving the problems are as follows:

<1> A thermosensitive recording medium, containing:

a support;

a thermosensitive recording layer; and a surface layer, where the thermosensitive recording layer and the surface layer are provided over the support, wherein the thermosensitive recording layer contains a binding agent, a coloring agent, and a color developer, and wherein the surface layer contains polyester (meth)acrylate having at least three (meth)acryloyl groups, and an α-hydroxyketone-based polymerization initiator having a melting point of 80° C. or higher.

<2> The thermosensitive recording medium according to <1>, wherein the surface layer further contains an acyl phosphinoxide-based polymerization initiator.

<3> The thermosensitive recording medium according to any of <1> or <2>, wherein the surface layer further contains filler, a lubricant, or both thereof.

<4> The thermosensitive recording medium according to any one of <1> to <3>, wherein the surface layer further contains a polyorganosiloxane-polyether copolymer.

<5> The thermosensitive recording medium according to any one of <1> to <4>, wherein the surface layer is formed by ultraviolet irradiation which is performed with an oxygen concentration of 0.1% to 1%, and ultraviolet irradiation intensity of 50 mJ/cm$^2$ to 200 mJ/cm$^2$.

<6> The thermosensitive recording medium according to any one of <1> to <5>, further containing an intermediate layer provided between the thermosensitive recording layer and the surface layer, wherein the intermediate layer contains a water-soluble resin, water-dispersible resin, or both thereof.

<7> The thermosensitive recording medium according to <6>, wherein the thermosensitive recording layer, the intermediate layer, or both thereof contain un ultraviolet absorber.

<8> The thermosensitive recording medium according to any of <6> or <7>, wherein at least one layer selected from the group consisting of the thermosensitive recording layer, the intermediate layer, and the surface layer contains a fluorescent dye.

<9> The thermosensitive recording medium according to any one of <1> to <8>, further containing a back layer provided on a surface of the support opposite to the surface thereof where the thermosensitive recording layer is provided, wherein the back layer contains a binder.

<10> The thermosensitive recording medium according to <9>, wherein the back layer further contains filler.

<11> The thermosensitive recording medium according to any of <9> or <10>, wherein the back layer further contains an antistatic agent.

<12> The thermosensitive recording medium according to any one of <9> to <11>, wherein the back layer, the surface layer, or both thereof further contain an antistatic agent.

<13> The thermosensitive recording medium according to any one of <1> to <12>, wherein the surface layer further contains fatty acid amide.

The ultraviolet-curing resin is used in the present invention to prevent unintentional omission of images due to depositions to a head and sticking during printing, while maintaining high glossiness. Moreover, the present inventors have found the particular combination with the polymerization initiator which is highly efficient as well as giving less yellowing, to prevent odor or yellowing during ultraviolet irradiation. Furthermore, to reduce the irradiation amount of ultraviolet rays reaching the materials of the thermosensitive recording layer, the present inventors have found the reduction of the irradiation amount by improving irradiation efficiency, and the particular ultraviolet absorber which causes less yellowing. Furthermore, the present inventors have achieved the present invention, which exhibits excellent effects, such as providing a reflective thermosensitive recording medium, which has high glossiness on the recording side, reduces an irradiation amount by reflection, prevents sticking during printing, has excellent water resistance and solvent resistance, does not cause a problem in handling due to odor, and is particularly suitable for medical use.

In accordance with the present invention, various problems in the art can be provided, and the present invention provides to a thermosensitive recording medium, which maintains its high glossiness, causes no image failure due to the depositions to a head, nor sticking during printing, gives excellent color tones of a background and an image, causes no curling or charging, and gives high gradation. Especially, the present invention provides a reflective thermosensitive recording medium suitable for medical use, which can be used for diagnoses or references of X-ray, MRI, CT images or the like, and attains excellent head matching ability, as well as attaining high image quality, glossiness, density, and gradation, all of which are at the same level as that of a silver halide photographic film.

DETAILED DESCRIPTION OF THE INVENTION

The thermosensitive recording medium of the present invention contains a support, and over the support, at least a thermosensitive recording layer and a surface layer, and may further contain an intermediate layer, a back layer, and other layers, if necessary.

<Surface Layer>

The surface layer contains at least polyester (meth)acrylate having at least three (meth)acryloyl groups, and an α-hydroxyketone-based polymerization initiator having a melting point of 80° C. or higher, and may further contain other substances, if necessary.

An ultraviolet curing resin for use in the present invention is preferably mainly formed of polyester (meth)acrylate having three or more (meth)acryloyl groups, because it requires high glassiness and heat resistance. The amount of the ultraviolet curing resin is preferably 30% by mass to 100% by mass relative to the total amount of the resins. When the amount of the ultraviolet curing resin is less than 30% by mass, the intended effect may not be attained.

The polyester (meth)acrylate having three or more (meth) acryloyl groups may be selected from those obtained by an esterification reaction between polyhydric alcohol, polybasic acid or polybasic acid anhydride (both may be referred to as polybasic acid (anhydride) hereinafter), and (meth)acrylic acid. Specific examples thereof include: polyester di(meth) acrylate of polyester diol that is obtained from maleic acid (anhydride) and ethylene glycol; polyester (meth)acrylate of polyester that is obtained from phthalic acid(anhydride) and diethylene glycol; di(meth)acrylate of polyester diol that is obtained from tetrahydrophthalic acid (anhydride) and diethylene glycol; di(meth)acrylate of polyester diol that is obtained from adipic acid and triethylene glycol; and poly (meth)acrylate of polyester polyol that is obtained from tetrahydrophthalic acid (anhydride) and diethylene glycol.

These polyester (meth)acrylates are commercially available, and examples of the commercial products thereof include ARONIX M-7100, ARONIX M-7200, ARONIX M-8030, ARONIX M-8060, ARONIX M-8100, ARONIX M-8530, ARONIX M-8560, and ARONIX M-9050, all manufactured by TOAGOSEI CO., LTD. However, polyester (meth)acrylates are not limited to these products, and conventional materials thereof can also be used.

When the polyester (meth)acrylate has two or less (meth) acryloyl groups, the resulting crosslinking density is not enough to attain intended heat resistance, and thus such polyester (meth)acrylate cannot used as a main component of the surface layer. However, it is possible to use 0 parts by mass to 100 parts by mass of the polyester (meth)acrylate having two or less (meth)acryloyl groups relative to 100 parts by mass of the polyester (meth)acrylate having three or more (meth) acryloyl groups for the purpose of giving flexibility to the surface layer and preventing curling or cracking.

Moreover, as the number of the (meth)acryloyl groups contained increases, the resulting crosslinking density increases, which increase the heat resistance of the resulting surface layer. However, on the other hand, the flexibility of the surface layer decreases, which may causes curling or cracking. For these reasons, the number of the (meth)acryloyl groups contained is preferably 3 to 8, more preferably 3 to 6, even more preferably 3 to 4, and particularly preferable that the polyester (meth)acrylate having these numbers of the (meth)acryloyl groups is contained as a main component of the surface layer, i.e. in an amount of 90% or more.

Furthermore, the polyester (meth)acrylate having three or more (meth)acryloyl groups may be used in combination with two or more resins for improving heat resistance, flexibility, and hardness.

To progress the curing of ultraviolet-curing resin by ultraviolet irradiation, the presence of a polymerization initiator is essential. As the polymerization initiator, various materials are used such as α-hydroxyketone-based polymerization initiator, α-aminoketone-based polymerization initiator, acyl phosphin oxide-based polymerization initiator, oxime-based polymerization initiator, sulfonium salt-based polymerization initiator, iodonium salt-based polymerization initiator, diazonium salt-based polymerization initiator, and ferrocenium salt-based polymerization initiator. However, to obtain the hardness, less yellowing, less odor, and heat resistance for printing all of which the present invention aimes to achieve, as a polymerization for use in the thermosensitive recording medium of the present invention, α-hydroxyketone-based polymerization initiator is preferable, and the melting point thereof is preferably 80° C. or higher. Use of such polymerization initiator has an effect of reducing odor of the resulting thermosensitive recording medium because such polymerization initiator has low volatility and a by-product thereof after the reaction has low odor. Moreover, there is also an effect of generating less deposition to a head by heat from printing.

Examples of the α-hydroxyketone-based polymerization initiator include IRGACURE 2959 and IRGACURE 127, both manufactured by BASF Japan Ltd., but the examples thereof are not limited to these products. As the α-hydroxyketone-based polymerization initiator, the conventional materials known in the art can also be used.

The total amount of the polymerization initiator(s) is preferably 0.5 parts by mass to 8 parts by mass, relative to 100 parts by mass of the total amount of the ultraviolet-curing resin.

When the amount of the polymerization initiators is less than 0.5 parts by mass, ultraviolet curing does not sufficiently progress. When the amount thereof is more than 8 parts by mass, the excessive part of the initiator may be fused by the heat applied for printing, and the fused matter may attach to a head, which causes image failures. For efficiently progressing curing and maintaining the irradiation amount of UV, the total amount of the polymerization initiators is more preferably 1 part by mass to 5 parts by mass.

Moreover, as a solution for preventing fused depositions to the head as well as progressing curing, it is extremely effective to use the aforementioned curing agent together with an acyl phosphinoxide-based polymerization initiator. Examples of such material include IRGACURE 819, IRGACURE 1800, IRGACURE 1870, DAROCUR TPO, and DAROCUR 4265, all of which are manufactured by BASF Japan Ltd.

Moreover, by using the α-hydroxyketone-based polymerization initiator having a melting point of 80° C. or higher and the acyl phosphinoxide-based polymerization initiator in combination, a large effect can be exhibited especially in terms of curing, and prevention of odor, yellowing, and depositions to a head.

In the case where the α-hydroxyketone-based polymerization initiator and the acylphosphinoxide-based polymerization initiator are used in combination, the mass ratio of the α-hydroxyketone-based polymerization initiator to the acylphosphinoxide-based polymerization initiator is preferably 90/10 to 10/90, more preferably 80/20 to 20/80. By using a combination of the α-hydroxyketone-based polymerization initiator and the acylphosphinoxide-based polymerization initiator at the aforementioned mass ratio, the intended effects of the invention can be significantly exhibited.

Under the consideration of preventing yellowing, the polymerization initiator is preferably selected from those having an absorption range of 300 nm to 365 nm. These materials may be used in combination depending on the intended effect to attain.

The light source for ultrasonic irradiation is suitably selected from those known in the art without any restriction. Specific examples thereof include a high pressure mercury lamp, a metal halide lamp, a mercury-xenon lamp, a xenon lamp, and an UV-LED lamp.

A type of the lamp is particularly preferably the one having the emission properties corresponding to the absorption wavelength of the polymerization initiator, and preferably the one having the strong emission at the absorption wavelength range of the polymerization initiator, i.e. 300 nm to 365 nm.

The conditions for the irradiation may be varied depending on the lamp for use, the ultraviolet-curing resin for use, the curing agent for use, the amounts thereof, the temperature of the support, oxygen concentration, and the like. It has been known that the curing reaction slows down or less progresses in the presence of oxygen. To reduce the inhibition by oxygen, it has been tried that light is applied for irradiation after laminating the layers, or the curing atmosphere is filled with inert gas such as nitrogen and $CO_2$. In the present invention, the method of filling the curing atmosphere with inert gas such as nitrogen and $CO_2$ has been found simple and also effective.

In order to prevent yellowing due to ultraviolet irradiation, a conventional ultraviolet absorber, antioxidant, light stabilizer, and the like can be added to the thermosensitive recording layer, or to any of the intermediate layer and the surface layer provided above the thermosensitive recording layer. Since the leuco dye contained in the thermosensitive recording layer of the thermosensitive recording medium is easily affected by light, it is effective to reduce the amount of ultraviolet rays reaching the thermosensitive recording layer. To this end, it is preferred that the ultraviolet absorber be added.

The ultraviolet absorber is suitably selected from those known in the art without any restriction. Examples thereof include: inorganic ultraviolet absorber such as zinc oxide, and titanium oxide; and ultraviolet absorbers of benzotirazole, benzophenone, benzoate, salicylic acid, cyanoacrylate, and hydroxyphenyltriazine. These may be used in any form, such as being dissolved, dispersed, emulsified, encapsulated in a microcapsule, and copolymerized with a polymer. The form thereof can be suitably selected depending on the intended layer to be used in, and the compatibility to the other materials to form a layer with.

Moreover, the present inventors have found that among ultraviolet absorbers hydroxyphenyltriazin itself is less colored, has strong absorption at the range around 300 nm, irradiation of which causes yellowing of the recording layer, and gives a strong effect for preventing yellowing.

Moreover, it is also effective to add a commonly known fluorescent dye to adjust the color tone affected by yellowing. By adding the fluorescent dye, the yellowed color tone can be adjusted, and a thermosensitive recording medium having high whiteness can be achieved without losing a balance of the total color tone.

Various commonly used inorganic pigments can be used as a pigment (i.e. filler) for use in the surface layer. Specific examples thereof include: inorganic pigments such as zinc oxide, calcium carbonate, barium sulfate, titanium oxide, lithopone, talc, agalmatolite, kaolin, aluminum hydroxide, and fired kaolin. Moreover, these inorganic pigments can be used in combination with organic pigments such as urea-formalin resin, and polyethylene powder.

Since one of the aims of the present invention is to provide a desirable surface glossiness to the thermosensitive recording medium, the pigment preferably selected from those having oil absorption of 100 cc/100 g or less and a specific surface area of 100 $m^2/g$ or more. Among such pigments, aluminum hydroxide, kaolin, calcium carbonate, and the like are preferable because they are easily pulverized and give excellent surface glossiness.

Moreover, in the present invention, other than the inorganic pigment, an organic pigment can also be used, and various commonly known organic pigments can be used such as polystyrene resin, polyethylene resin, polypropylene resin, urea-formalin resin, silicone resin, polymethacrylic acid methylacrylate resin, melamine-formaldehyde resin, and condensation polymers such as polyester, and polycarbonate.

The average particle diameter of the filler is preferably 0.1 μm to 3.5 μm. When the average particle diameter thereof is less than 0.1 μm, the effect obtainable by adding the filler is hardly exhibited. When the average particle diameter thereof is more than 3.5 μm, the filler causes not only reduction in the sensitivity of the resulting thermosensitive recording medium, but also losing the glossiness gaining of which is one of the aims to achieve in the present invention, generating white-spots especially in the half-tone, and causing a problem in the uniformity of the resulting image to be recorded.

The surface layer optionally contains a conventional lubricant, as long as the amount of the lubricant contained do not lower the intended glossiness.

Examples thereof include animal wax, vegetable wax, mineral wax, and petroleum wax, and specific examples thereof include higher fatty acid and metal salts thereof; higher fatty acid amide; higher fatty acid ester; montanic acid wax, polyethylene wax, paraffin wax, carnauba wax, and rice bran wax. These may be used independently or in combination.

Among them, a metal salt of higher fatty acid has high lubricity and mould releasing performance, and has properties for preventing sticking or has high effect of preventing depositions to a head. Moreover, it has been confirmed that among metal salts of higher fatty acid, zinc stearate has a significant effect, and provides desirable qualities to the resulting thermosensitive recording medium.

In order to record a medical image, recording of which particularly requires gradations of the image, the thermosensitive recording medium for use needs to respond to various thermal energies applied from a thermal head corresponding to an image to be recorded. To this end, two or more types of lubricant particles each having a different melting point are used in combination to exhibit the required effect. In other wards, by fusing the lubricants corresponding to all images including of low printing ratio to high printing ratio, the prevention of the depositions, prevention of sticking, high image glossiness, and pure black color in an image can be achieved regardless of the printing ratio of the image.

The melting point of the lubricant is preferable 50° C. to 180° C. When the melting point is lower than 50° C., blocking tends to occur if the resulting thermosensitive recording medium is stored under high temperature environment, or the lubricant of low melting point tends to bleed out on the surface of the resulting thermosensitive recording medium after recording by heat of a thermal head, and therefore there is a problem that precipitations like a white powder tends to appear on the surface of the thermosensitive recording medium.

When the melting point is higher than 180° C., as such lubricant is hard to be melted by the heat of the thermal head for recording, the lubricant has less effect of providing mold-releasing performance to prevent depositions to the thermal head.

Moreover, in order to attain the intended glossiness, the volume average particle diameter of the lubricant for use is preferably 0.01 μm to 0.9 μm. When the volume average particle diameter thereof is less than 0.01 μm, sufficient lubricity or mold-releasing performance cannot be obtained. When the volume average particle diameter thereof is more than 0.9 μm, the resulting glossiness is low in the case where a large amount of the lubricant is added.

In the case where two or more types of the lubricants particles are contained, "the average particle diameter of the lubricant" means the average particle diameter measured in a liquid in which these two or more types of the lubricants particles are mixed. For this reason, a dispersion liquid of a few types of the lubricants particles which causes aggregations of the particles is not appropriate.

Moreover, even through one type of the lubricant has a slightly larger average particle diameter than the aforementioned range, by reducing the proportion of such lubricant in the total amount of a few types of the lubricants particles for use, the average particle diameter of the lubricant can be adjusted within the aforementioned range.

The total amount of the lubricants is preferably about 0.05 parts by mass to about 1.0 part by mass, more preferably about 0.1 parts by mass to about 0.5 parts by mass, relative to 1 part of the resin used for the surface layer. By adjusting the volume average particle diameter of the lubricants fine, i.e., 0.01 μm to 0.9 μm, glossiness of the pre-heated surface layer can be maintained with a large amount of the lubricants for use.

Various methods known in the art, such as emulsification and crushing using various beads, can be used as the method of pulverizing the lubricant to have the volume average particle diameter of 0.01 μm to 0.9 μm.

In the case where these lubricants are pulverized in an aqueous medium, it is difficult to perform pulverization in the aqueous medium containing only the lubricants, and thus it is preferred that pulverization of the lubricants be performed together with the conventional water-soluble resin or surfactant.

The method of coating the surface layer is not particularly limited, and can be carried out in accordance with any of the conventional methods known in the art. The thickness of the surface layer is preferably 0.5 μm to 20 μm, more preferably 1.0 μm to 10 μm. When the surface layer is too thin, curing is not sufficiently carried out due to inhibition by oxygen present adjacent to the surface of the surface layer, and thus the intended heat resistance cannot be attained. When the thickness thereof is too thick, thermal sensitivity of the resulting thermosensitive recording medium reduces, and it is also disadvantageous in terms of cost.

—Intermediate Layer—

It is effective to provide an intermediate layer mainly formed of a resin between the thermosensitive recording layer and the surface layer, and extremely high glossiness of the resulting thermosensitive recording medium can be attained by making the intermediate layer a layer having a high proportion of the resin.

In the case where the intermediate layer is provided, the intermediate layer is preferably mainly formed of a water-soluble resin and/or a water dispersible resin to achieve high glossiness. Especially for preventing fogging on the thermosensitive recording layer due to materials of the surface layer or a solvent contained in a coating liquid, it is important that the intermediate layer has a barrier function. To this end, various resins known in the art can be used. Moreover, the resin may be used and reacted with a crosslinking agent.

The method of coating the intermediate layer is not particularly limited, and can be carried out in accordance with any of conventional methods known in the art. The thickness of the intermediate layer is preferably 0.1 μm to 20 μm, more preferably 0.5 μm to 10 μm. When the intermediate layer is too thin, the resulting properties such as glossiness, water resistance, and solvent resistance are insufficient. When the thickness thereof is too thick, thermal sensitivity of the resulting thermosensitive recording medium reduces, and it is also disadvantageous in terms of cost.

<Thermosensitive Recording Layer>

The thermosensitive recording layer contains a binding agent, a coloring agent and a color developer, and may further contain other components, if necessary.

—Color Developer—

As the color developer, various electron-accepting compounds that react with the leuco dye upon heating to develop a color are used. Specific examples thereof include phenol compounds, organic or inorganic acid compounds, and esters or salts thereof, such as shown below.

gallic acid, salicylic acid, 3-isopropyl salicylate, 3-cyclohexyl salicylate, 3,5-di-tert-butyl salicylate, 3,5-di-α-methylbenzyl salicylate, 4,4'-isopropylidene diphenol, 1,1'-isopropylidene bis(2-chlorophenol), 4,4'-isopropylidene bis(2,6-dibromophenol), 4,4'-isopropylidene bis(2,6-dichlorophenol), 4,4'-isopropylidene bis(2-methylphenol), 4,4'-isopropylidene bis(2,6-dimethylphenol), 4,4-isopropylidene bis(2-tert-butylphenol), 4,4'-sec-butylidene diphenol, 4,4'-cyclohexylidene bisphenol, 4,4'-cyclohexylidene bis(2-methylphenol), 4-tert-butylphenol, 4-phenylphenol, 4-hyroxydiphenoxide, α-naphthol, 6-naphthol, 3,5-xylenol, thymol, methyl-4-hydroxybenzoate, 4-hydroxyacetophenone, Novolak phenol resin, 2,2'-thiobis(4,6-dichlorophenol), catechol, resorcin, hydrochinone, pyrogallol, fluoroglycine, fluoroglycine carboxylic acid, 4-tert-octylcatechol, 2,2'-methylene bis(4-chlorophenol), 2,2'-methylene bis(4-methyl-6-tert-butylphenol), 2,2,-dihydroxydiphenyl, ethyl p-hydroxy benzoate, propyl p-hydroxy benzoate, butyl p-hydroxy benzoate, benzyl p-hydroxy benzoate, p-chlorobenzyl-p-hydroxy benzoate, o-chlorobenzyl-p-hydroxy benzoate, p-methyl benzyl-p-hydroxy benzoate, n-octyl-p-hydroxy benzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butyl salicylate, tin 3,5-di-tert-butyl salicylate, tartaric acid, oxalic acid, maleic acid, citric acid, succinic acid, stearic acid, 4-hydroxy phthalic acid, boric acid, thiourea derivatives, 4-hydroxythiophenol derivatives, bis(4-hydroxyphenyl)acetic acid, ethyl bis(4-hydroxyphenyl)acetate, n-propyl bis(4-hydroxyphenyl)acetate, m-butyl bis(4-hydroxyphenyl)acetate, phenyl bis(4-hydroxyphenyl)acetate, benzyl bis(4-hydroxyphenyl)acetate, phenethyl bis(4-hydroxyphenyl)acetate, bis(3-methyl-4-hydroxyphenyl)acetic acid, methyl bis(3-methyl-4-hydroxyphenyl) acetate, n-propyl bis(3-methyl-4-hydroxyphenyl)acetate, 1,7-bis(4-hydroxyphenylthio)-3,5-dioxaheptane, 1,5-bis(4-hydroxyphenylthio)-3-oxaheptane, dimethyl-4-hydroxy phthalate, 4-hydroxy-4'-methoxydiphenyl sulfone, 4-hydroxy-4'-ethoxydiphenyl sulfone, 4-hydroxy-4'-isopropoxydiphenyl sulfone, 4-hydroxy-4'-propoxydiphenyl sulfone, 4-hydroxy-4'-butoxydiphenyl sulfone, 4-hydroxy-4'-isobutoxydiphenyl sulfone, 4-hydroxy-4-butoxydiphenyl sulfone, 4-hydroxy-4'-tert-butoxydiphenyl sulfone, 4-hydroxy-4'-benzyloxydiphenyl sulfone, 4-hydroxy-4'-phenoxydiphenyl sulfone, 4-hydroxy-4'-(m-methylbenzyloxy)diphenyl sulfone, 4-hydroxy-4'-(p-methylbenzyloxy)diphenyl sulfone, 4-hydroxy-4'-(O-methylbenzyloxy)diphenyl sulfone, and 4-hydroxy-4'-(p-chlorobenzyloxy)diphenyl sulfone.

The amount of the color developer in the thermosensitive recording layer is preferably 0.5 parts by mass to 5.0 parts by mass, more preferably 2.0 parts by mass to 4.0 parts by mass, relative to 100 parts by mass of the leuco dye. When the amount of the color developer is within the aforementioned range, particularly the image preserving ability of the color developer improves. Moreover, at the same time, the coloring efficiency increases, and thus the maximum density can be provided with a thin film. Advantages for reducing a thickness of a gradation medium are easy thickness control during coating, and reduction in residual moisture or solvent in a drying process, and moreover the reduction in the coating amount lead to the reduced cost.

The leuco dye for use in the present invention is an electron-donating compound, which may be used independently or in combination, and is a colorless or light color dye precursor. The leuco dye for use is suitably selected from those known in the art without any restriction. Preferable examples of thereof include triphenylmethanephthalide-based leuco compounds, triallylmethane-based leuco compounds, fluoran-based leuco compounds, phenothiazine-based leuco compounds, thiofluoran-based leuco compounds, xanthen-based leuco compounds, indolyl phthalide-based leuco compounds, spiropyran-based leuco compounds, azaphthalide-based leuco compounds, chlormenopirazole-based leuco compounds, methine-based leuco compounds, rhodamine anilinolactum-based leuco compounds, rhodamine lactum-based leuco compounds, quinazoline-based leuco compounds, diazaxanthen-based leuco compounds, and bislactone-based leuco compounds. Among them, the fluoran-based leuco dye and the phthalide-based leuco dye are particularly preferable. Examples of such compound are those listed below, but not limited thereto.

2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(Nisopropyl-N-methylamino)fluoran, 2-anilino-3-methyl-6-(Nisobutyl-N-methylamino)fluoran, 2-anilino-3-methyl-6-(N-n-amyl-N-methylamino)fluoran, 2-anilino-3-methyl-6-(N-sec-butyl-N-ethylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-N-p-toluidino)fluoran, 2-anilino-3-methyl-6-(N-methyl-N-p-toluidino)fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chlorofluoran, 10-diethylamino-2-ethylbenzo[1,4]thiazino[3,2-b]fluoran, 3,3-bis (1-n-butyl-2-methylindol-yl)phthalide, 3,3-bis(4-diethylamino-2-ethoxyphenyl)-4-azaphthalide, 3-[2,2-bis (1-ethyl-2-methyl-3-indolyl)vinyl]-3-(4-diethylaminophenyl)phthalide, and 3-[1,1-bis(4-diethylaminophenyl)ethylen-2-yl]-6-dimethylaminophthalide.

Particularly in case of the thermosensitive recording medium of medical use, it is preferred that three or more leuco dyes be used in combination for attaining a single color tone.

To this end, as a second condition for the thermosensitive recording medium, it is preferred that to a black coloring leuco dye, one or more of each of a red coloring leuco dye and/or orange coloring leuco dye as well as far infrared coloring dye be mixed. Moreover, as the black leuco dye, it is preferred that at least a leuco dye expressed by the following general formula (I) be used.

(1)

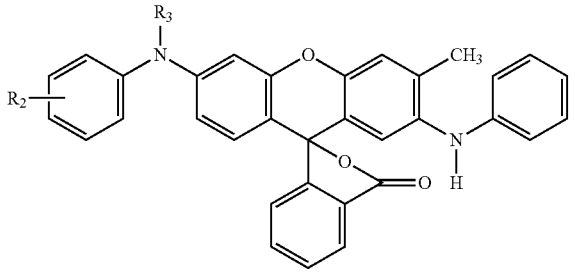

In the general formula (I) above, R2 is a hydrogen atom, a halogen atom, a C1-C4 alkyl group or a C1-C4 alkoxy group, and R3 is a C1-C4 alkyl group.

Specific examples of a compound expressed by the general formula (I) include 2-anilino-3-methyl-6-(N-ethyl-p-tolylamino)fluoran, and 2-anilino-3-methyl-6-(N-methyl-p-tolylamino)fluoran.

In other words, at least three or more leuco dyes are mixed in total, and 4 to 6 leuco dyes are mixed, if necessary. Note that, "the red coloring leuco dye," "the orange coloring leuco dye," and "the infrared coloring leuco dye" respectively means a dye whose color generated by heating being in the respective absorption wavelength range. The reason for adding the red coloring dye or the orange coloring dye, and the infrared coloring leuco dye is to make the absorption in the visible range as flat as that of a silver halide photographic film by filling cleavages presenting around the range of 450 nm to 600 nm and around the range of 650 nm to 700 nm formed by two absorption bands of the coloring matter obtained using the leuco dye expressed by the general formula (1).

The degree of blackness of an image can be substantially expressed by a ratio of the minimum value to maximum value of absorbance in the range of 430 nm to 650 nm on the absorption spectrum. When this ratio is 0.65 or more, a black color practical at least on a film view can be satisfied. Moreover, when the ratio is 0.75 or more, it is preferable because influences from a type of a fluorescent lamp for use, such as cool white and daylight can be reduced. As a mixing ratio of these dyes, it is preferred that the proportion of the black coloring leuco dye having a large absorption be large in view of attaining high density, controlling color tone, and giving preservation ability. Moreover, it is preferred that the amount of the leuco dye expressed by the general formula (I) be 40% by mass to 80% by mass of the total amount of the leuco dyes, and each of the red coloring leuco dye, the orange coloring leuco dye, and the infrared coloring leuco dye be 10% by mass to 30% by mass.

When the amount of the leuco dye expressed by the general formula (I) is more than the aforementioned range, it is difficult to give the desirable deep black color to an imaging part. When the amount thereof is less than the aforementioned range, it is difficult to maintain the desirable maximum density.

Examples of the red coloring leuco dye or orange coloring leuco dye used and mixed with the black coloring leuco dye expressed by the general formula (I) include rhodamine-B-o-chloroanilinolactam, 3,6-bis(diethylamino)fluoran-γ-(4'-nitro)anilinolactam, 1,3-dimethyl-6-diethylaminofluoran, 1,3-dimethyl-6-dibutylaminofluoran, 2-chloro-3-methyl-6-diethylaminofluoran, 2-chloro-6-diethylaminofluoran, 3-chloro-6-N-cyclohexylaminofluoran, 6-diethylaminobenzo[α]fluoran, 6-(N-ethyl-N-isopentylamino)benzo[α]fluoran, 3,3-bis(1-n-butyl-2-methylindol-3-yl)phthalide, 3,3-bis(1-n-octyl-2-methylindol-3-yl)phthalide, and spiro{chromeno[2,3-C]pyrazole-4(H)-1'-phthalan}-7-(N-ethyl-N-isoamylamino)-3-methyl-1-phenyl-3'-one.

In the case where the leuco dyes and the color developer are bound and set on the support to produce the thermosensitive recording medium of the present invention, various binding agents known in the art can be appropriately used. Examples thereof include: polyvinyl alcohol; starch and derivatives thereof; cellulose derivatives such as hydroxymethyl cellulose, hydroxyethyl cellulose, carboxymethyl cellulose, methyl cellulose, and ethyl cellulose; water-soluble polymers such as polyacrylate soda, polyvinyl pyrrolidone, acryl amide-acrylic acid ester copolymers, acryl amide-acrylic acid ester-methacrylic acid terpolymers, alkali salts of styrene-maleic anhydride copolymers, alkali salts of isobutylene-maleic anhydride copolymers, polyacryl amide, alginate soda, gelatin and casein; emulsions such as emulsions of polyvinyl acetate, polyurethane, polyacrylic acid, polyacrylate, vinyl chloride-vinyl acetate copolymer, polybutyl methacrylate, and ethylene-vinylacetate copolymer; latex such as latex of styrene-butadiene copolymer, styrene-butadiene-acryl copolymer.

These may be used with a surfactant, a crosslinking agent, and an adjuvant. By using the binding agent and a crosslinking agent reactive to the binding agent together, adhesion to the support increases, as well as increasing water resistance and solvent resistance. As the crosslinking agent, various crosslinking agents commonly used in the art can be used.

Moreover, the thermosensitive recording layer may further contain auxiliary additives selected from those commonly used for this type of the thermosensitive recording medium, such as filler, thermal fusion material, and a surfactant, if necessary, together with the leuco dye and the color developer. In this case, examples of the filler for use include: inorganic powder such as calcium carbonate, silica, zinc oxide, titanium oxide, aluminum hydroxide, zinc hydroxide, barium sulfate, clay, talc, surface-treated calcium, and surface-treated silica, urea-formalin resin, as well as organic powder such as styrene-methacrylic acid copolymer powder, and polystyrene resin powder. Moreover, examples of the thermal fusion material include: higher fatty acid and esters thereof, amides thereof, metal salts thereof; various waxes; condensation products of aromatic carboylic acid and amine; phenyl benzoate; higher linear glycol dialkyl-3,4-epoxyhexahydrophthalate; higher ketone; p-benzylbiphenyl, and other thermal fusion organic compounds each having a melting point of approximately 50° C. to approximately 200° C.

The method of coating the thermosensitive recording layer is not particularly limited, and can be carried out in accordance with any of the conventional methods known in the art. The thickness of the thermosensitive recording layer is preferably 1 μm to 30 μm, more preferably 3 μm to 20 μm. When the thickness thereof is too thin, the image density of the resulting image is insufficient. When thickness thereof is too thick, the thermal sensitivity of the resulting thermosensitive recording medium decreases, the background fogging occurs, and it is also desirable in terms of the cost.

<Support>

The support for use can be selected from those used in conventional leuco-type thermosensitive recording media. Examples thereof include a plastic film, paper, plastic resin laminate paper, and synthetic paper. In the case of a transparent thermosensitive recording medium, a clear support is used. Specific examples of the clear support include: cellulose derivatives such as cellulose triacetate; polyolefine such as polypropylene, and polyethylene; polystyrene; and laminate films thereof. Among them, the preferably clear support is a synthetic paper mainly formed of polypropylene resin, but it is not limited to such synthetic paper. Among them, for use of recording reflective images, those having high opacity and high whiteness are preferable in view of the intended image contrast to attain. Moreover, in view of the surface glossiness, image reproducibility, and vividness to attain, those having smooth surface and high glossiness are preferable.

Assuming that a surface of the support on which a thermosensitive recording layer will be provided has a surface glossiness, i.e. 75-degrees specular glossiness (Gs 75°), of 50% or more in accordance with JIS-P-8142, the thermosensitive recording medium using such support has excellent contactability to a thermal head, as well as excellent surface glossiness, and thus also has effects of forming vivid images and preventing unintentionally unprinted image upon printing, and improving sensitivity.

As a method for improving qualities of a thermosensitive recording medium such as glossiness or sensitivity, a method of smoothing a thermosensitive recording medium by super-calendering, or the like has been generally used. However, by using the aforementioned support having a surface glossiness, i.e. 75-degrees specular glossiness (Gs 75°), of 50% or more in accordance with JIS-P-8142, such smoothing process can be emitted, and the production procedure can be simplified.

Moreover, at least one surface of the support can be subjected to a surface treatment by corona discharge, or oxidation reaction treatment (e.g. using chromic acid and the like) to improve the adhesion to the coating layer of the thermosensitive recording layer coating liquid.

Moreover, for thermosensitive recording media of medical use, the support is preferably a synthetic paper mainly formed of polypropylene, having a thickness of approximately 50 μm to approximately 250 μm in view of handling and the like.

—Back Layer—

It is preferred that the thermosensitive recording medium of the present invention further contain a back layer on a surface of the support opposite to the surface on which the thermosensitive recording layer and the surface layer are provided.

The back layer may be designed to have functions such as antistatic function, function of preventing curling, and function of preventing cohesion of thermosensitive recording media by stacking.

The resin used for the back layer is suitably selected from various resins known in the art, and examples thereof include polyethylene, polyvinyl acetate, polyacrylamide, maleic acid copolymer, polyacrylic acid and esters thereof, polymethacrylic acid and esters thereof, vinyl chloride-vinyl acetate copolymer, styrene copolymer, polyester, polyurethane, polyvinylbutyral, ethyl cellulose, polyvinyl acetal, polycarbonate, epoxy resin, polyamide, polyvinyl alcohol, starch, and gelatin. These resins may be used independently or in combination.

The resin for use can be selected by considering affinity to the support or antistatic agent for use.

The resin (i.e. a binder) of the back layer preferably has a glass transition temperature Tg of 80° C. or higher, which is effective in case where the resin has large volume contraction upon ultraviolet curing and tends to curl at the side where thermal recording is performed.

Furthermore, it is effective to add a matting agent to the back layer (e.g. the antistatic layer) to give an effect of preventing cohesion, because especially a surface layer of the thermosensitive recording medium of the present invention exposing to recording side has excellent glossiness, and easily cohered at the time the thermosensitive recording medium is formed into a roll or sheets. As the matting agent, filler can be used. Examples of the filler include: spherical inorganic filler such as phosphate fibers, calcium titanate, needle-shaped magnesium hydroxide, whisker, talc, mica, glass bead flakes, calcium carbonate, tabular calcium carbonate, aluminium hydroxide, silica, clay, kaolin, baked clay, and hydrotalcite; and spherical organic filler such as polystyrene resin, polyethylene resin, polypropylene resin, urea-formalin resin, silicone resin, polymethacrylic acid methylacrylate resin, melamine-formaldehyde resin, condensation polymers such as polyester, and polycarbonate. However, examples are not limited to those listed above.

The filler is preferably filler having an average particle diameter of 6 μm to 20 μm especially for preventing cohesion, and more preferably spherical filler because such filler efficiently provides concave portions on the surface of the back layer.

For the purpose of obtaining uniform images and desirable gradation, it is preferred that a plastic film such as polypropylene, polyesterterephthalate be used as the support. Since such plastic film is extremely easily charged, however, it is afraid that use of the plastic film may cause image failures by attracting floating dusts in the air by the charge, or may destroy a thermal head by the charge.

For this reason, it is preferred that the thermosensitive recording medium of the present invention be provided with antistatic properties.

In order to give antistatic properties to the thermosensitive recording medium, it is a common practice to add an antistatic agent to a back side of the thermosensitive recording medium, which is generally opposite to the side of the thermosensitive recording medium subjected to recording.

As the antistatic agent, various antistatic agents have been used for various purposes. For attaining antistatic properties, the surface resistance needs to be $10^{10}$ Ω·cm or less.

The antistatic agents capable of giving such degree of conductivity are largely classified into antistatic agents using surfactants, antistatic agents using conductive metal oxides, and antistatic agents using conductive polymers.

The majority of the currently used antistatic agents are those using surfactants. Such surfactants are roughly classified into four types of an anionic surfactant, a cationic surfactant, a nonionic surfactant, and an ampholytic surfactant, but as the antistatic agent, the cationic surfactant and ampholytic surfactant are excellent in terms of charge control performance, and permanence. These surfactant type antistatic agents are relatively inexpensive, wide varieties thereof are available, and they exhibit good performances. However, as most of such antistatic agents provide conductivity by absorption of moisture by themselves, they are easily affected by humidity, and tend to lower their antielectricity performances under low humidity environment.

The conductive polymers are materials which have been recently developed, and examples thereof include a material in which an organic macromolecule is doped with an electron donor. Examples of the organic macromolecule used include: macromolecules of conjugated system, such as aliphatic polymers (e.g. polyacetylene), aromatic polymers (e.g. polyparaphenylene), heterocycles (e.g. polypyrrole), and aromatic amines (e.g. polyaniline); and macromolecules in each of which a principal chain thereof is not conjugated system, but a side chain thereof contains a cyclic n conjugated group. These macromolecular materials are doped with electron donors. Similar to the conductive metal oxides, these conductive polymers do not have conductivity owing to moisture, and hence exhibit conductivity under low humidity environment. Although it is depending on a macromolecule for use and an electron donor for use, it is possible to design the conductivity of the conductive polymer extremely high, and therefore sufficient antistatic properties can be provided to even a thin film.

The antistatic agents using conductive metal oxides have less variety compared to those of the surfactant type, and expensive. However, metal oxides themselves are conductive, and thus the conductivities thereof are high, and excellent conductive performance can be exhibited with a small amount thereof, which is effective to maintain high transparency of the resulting thermosensitive recording medium. Moreover, they exhibit excellent antielectricity under low humidity environment, without being affected by humidity. Examples of the conductive metal oxides include: single metal oxides, such as $SnO_2$, $In_2O_3$, ZnO, $TiO_2$, MgO, $Al_2O_3$, BaO, and $MoO_3$; and composite oxides in which the aforementioned single metal oxides are mixed with P, Sb, Sn, Zn, or the like, but examples are not limited to those listed above. Most of these metal oxides have colors, and use of which may impair the transparency of the thermosensitive recording medium. Therefore, it is preferred that the amount thereof for use is as small as possible, provided that it gives a sufficient effect of antielectricity.

To compensate the disadvantages mentioned above, two, three or more antistatic agents may be used in combination, such as a combination of the conductive metal oxide and the surfactant or the conductive polymer.

Moreover, the powdery antistatic agent is preferably finer. The finer the powder is more excellent transparency and antistatic effect can be attained. The antistatic agent for use in the present invention has an average particle diameter of 0.2 μm or less, and use of such antistatic agent provides excellent transparency.

The amount of the antistatic agent for use is preferably 0.05 parts by mass to 0.9 parts by mass, more preferably 0.1 parts by mass to 0.5 parts by mass, relative to 1 part by mass of the back layer. When the amount thereof is less than 0.05 parts by mass, the sufficient antistatic ability cannot be obtained. When the amount thereof is more than 0.9 parts by mass, the adhesion of the back layer to the support may be insufficient.

In the present invention, an antistatic agent may be added to the surface layer.

The antistatic agent added to the surface layer can be selected from the various materials known in the art as in that of the back layer, but it is more practical that the antistatic agent for use in the surface layer is a material dissolved with the ultraviolet-curing resin, or an ultraviolet-curing antistatic agent.

Moreover, it has been found in the course of the present invention that by adding fatty acid amide antistatic properties are provided as well as exhibiting lubricity effect.

Just after the production, the thermosensitive recording medium of the present invention is in the form of a long film, but the final product form thereof is a roll, in which the thermosensitive recording medium is rolled up, or sheets obtained by cutting the thermosensitive recording medium into a certain size, and placed in a bag. It is preferred that the final product of the both forms be generally wrapped with a light-blocking wrapping material because of the properties of the final product, and then be stored and distributed. When the product is used, the bag is opened to take out the thermosensitive recording medium, and the thermosensitive recording medium taken out is set in an image forming device.

The method for forming an image using the thermosensitive recording medium of the present invention is carried out for example in the following manner. The thermosensitive recording medium is heated imagewise by a heating unit based upon information of characters and/or shape to be recorded. The heading unit is suitably selected from a thermal pen, a thermal head, laser heating and the like depending on the intended purpose for use, without any restriction, but the thermal head is particularly preferable because the thermosensitive recording medium of the present invention is suitable for printing an image of high preciseness and high gradation, such as a medical image, and it is desirable considering the cost of the device, output speed, and the compact size of the device.

For medical use, it is required that an image has a gradation. As a method for giving gradation, a pulse control system or armature-voltage control system may be used.

EXAMPLES

The present invention will be more specifically explained through Examples hereinafter, but the Examples shall not be construed as limiting the scope of the present invention in any way. Note that, "part(s)" and "%" presented below are all mass basis, unless otherwise mentioned.

Example 1

(1) Formation of Thermosensitive Recording Layer

Ingredients of each of [Liquid A] and [Liquid B] were pulverized by a magnetic ball mill to have an average particle diameter of 1.5 μm or less, to thereby prepare [Liquid A] and [Liquid B].

[Liquid A] Dye Dispersion Liquid

| | |
|---|---|
| 2-anilino-3-methyl-6-di-butylaminofluoran | 20 parts |
| 10% polyvinyl alcohol aqueous solution | 20 parts |
| Water | 60 parts |

[Liquid B] Color Developer Dispersion Liquid

| | |
|---|---|
| 4-hydroxy 4'-isopropoxydiphenyl sulfone | 12 parts |
| Silica | 4 parts |
| Stearic acid amide | 4 parts |
| 10% polyvinyl alcohol aqueous solution | 20 parts |
| Water | 60 parts |

Next, [Liquid A], [Liquid B], and a modified polyvinyl alcohol (Kuraray K Polymer KL-318, solid contents: 10%) were mixed in the following formulation and stirred to prepare a thermosensitive recording layer coating liquid [Liquid C].

[Liquid C] Thermosensitive Recording Layer Coating Liquid

| | |
|---|---|
| Liquid A | 12.5 parts |
| Liquid B | 62.5 parts |
| 10% polyvinyl alcohol aqueous solution | 25 parts |

The thermosensitive recording layer coating liquid [Liquid C] was applied onto a 170 μm-thick synthesis paper (PX170, manufactured by Nan Ya Plastics Corporation, surface glossiness: 60%) by a wire bar, and passed through a dryer of the temperature of 70° C. for 3 minutes to dry, to thereby form a thermosensitive recording layer A (surface glossiness: 25%) having a thickness of 8.5 g/m$^2$.

(2) Formation of Intermediate Layer

The following ingredients were mixed to prepare an intermediate layer coating liquid [Liquid D].

[Liquid D] Intermediate Layer Coating Liquid

| | |
|---|---|
| Modified polyvinyl alcohol (Kuraray K Polymer KL-318, solid contents: 10%) | 80 parts |
| Acetylene diol | 0.01 parts |
| Water | 20 parts |

Onto the thermosensitive recording layer A, [Liquid D] was applied by a wire bar, and passed through a dryer having a temperature of 50° C. for 2 minutes for drying to laminate an intermediate layer having a thickness of 3 g/m$^2$, to thereby form a intermediate layer A (surface glossiness: 70%).

(3) Formation of Surface Layer

The following ingredients were mixed to prepare a surface layer coating liquid [Liquid E].

[Liquid E] Surface Layer Coating Liquid

| | |
|---|---|
| Tri-functional polyester acrylate (ARONIX M8060, manufactured by TOAGOSEI CO., LTD.) | 45 parts |
| α-hydroxyketone-based polymerization initiator (IRGACURE 127, manufactured by BASF Japan Ltd., melting point: 82° C. to 90° C.) | 5 parts |
| Zinc stearate | 2 parts |
| Methylethyl ketone | 50 parts |

After dispersing [Liquid E] by means of a ball mill filled with zirconium beads each having a diameter of 2 mm at 100 rpm for 2 hours, [Liquid E] was applied onto the intermediate layer A by a wire bar, passed through a dryer having the temperature of 50° C. for 1 minute for drying, irradiated with light emitted from a high pressure mercury lamp (80 W, 6.6 m/min, 300 mJ/cm$^2$) under atmospheric pressure to thereby form a surface layer (surface glossiness: 90%) having a thickness of 3 g/m$^2$. In the manner described above, a thermosensitive recording medium of Example 1 was prepared.

Example 2

A thermosensitive recording medium of Example 2 was prepared in the same manner as in Example 1, provided that the tri-functional polyester acrylate (ARONIX M8060, manufactured by TOAGOSEI CO., LTD.) used for the formation of the surface layer was replaced with tetra-functional polyester acrylate (ARONIX M9050, manufactured by TOAGOSEI CO., LTD.).

Example 3

A thermosensitive recording medium of Example 3 was prepared in the same manner as in Example 1, provided that the following polymerization initiators were used to form a surface layer, instead of using the polymerization initiator for the formation of the surface layer.

| | |
|---|---|
| α-hydroxyketone-based polymerization initiator (IRGACURE 2929, manufactured by BASF Japan Ltd., melting point: 87° C. to 92° C.) | 3 parts |
| Acylphosphenoxide-based polymerization initiator (IRGACURE 819, manufactured by BASF Japan Ltd., melting point: 127° C. to 133° C.) | 2 parts |

Example 4

A thermosensitive recording medium of Example 4 was prepared in the same manner as in Example 1, provided that the following polymerization initiators were used to form a surface layer, instead of using the polymerization initiator for the formation of the surface layer.

| | |
|---|---|
| α-hydroxyketone-based polymerization initiator (IRGACURE 2929, manufactured by BASF Japan Ltd., melting point: 87° C. to 92° C.) | 4 parts |
| Acylphosphenoxide-based polymerization initiator (IRGACURE 819, manufactured by BASF Japan Ltd., melting point: 127° C. to 133° C.) | 1 part |

Example 5

A thermosensitive recording medium of Example 5 was prepared in the same manner as in Example 1, provided that the following polymerization initiators were used to form a surface layer, instead of using the polymerization initiator for the formation of the surface layer.

| | |
|---|---|
| α-hydroxyketone-based polymerization initiator (IRGACURE 2929, manufactured by BASF Japan Ltd., melting point: 87° C. to 92° C.) | 1 part |
| Acylphosphenoxide-based polymerization initiator (IRGACURE 819, manufactured by BASF Japan Ltd., melting point: 127° C. to 133° C.) | 4 parts |

Example 6

A thermosensitive recording medium of Example 6 was prepared in the same manner as in Example 3, provided that 5 parts of silicone particles having an average particle diameter of 3 μm (KMP-590, manufactured by Shin-Etsu Chemical Co., Ltd.) was further added to the surface layer coating liquid used for forming the surface layer to thereby form a surface layer.

Example 7

A thermosensitive recording medium of Example 7 was prepared in the same manner as in Example 6, provided that 3 parts of polyorganosiloxane-polyether copolymer (57 ADDITIVE, manufactured by Dow Corning Toray Co., Ltd.) was further added to the surface layer coating liquid used for forming the surface layer to thereby form a surface layer.

Example 8

A thermosensitive recording medium of Example 8 was prepared in the same manner as in Example 7, provided that at the time for ultraviolet irradiation for forming the surface layer, ultraviolet rays were irradiated (100 mj/cm$^2$) at the oxygen concentration of 0.5% and at the conditions of 80 W, and 20 m/min.

Example 9

A thermosensitive recording medium of Example 9 was prepared in the same manner as in Example 7, provided that 0.2 parts of hydroxyphenyltriazin (TINUVIN 400DW, manufactured by BASF Japan Ltd.) was further added to the intermediate layer coating liquid as an ultraviolet absorber to form an intermediate layer.

Example 10

A thermosensitive recording medium of Example 10 was prepared in the same manner as in Example 9, provided that 0.05 parts of a fluorescent dye (BLANKOPHOR UW Liquid, manufactured by Kemira Japan K. K.) was further added to the intermediate layer coating liquid to form an intermediate layer.

Example 11

A thermosensitive recording medium of Example 11 was prepared in the same manner as in Example 10, provided that a back layer coating liquid A of the following formulation was applied to a surface of the support opposite to the surface thereof where the thermosensitive recording layer was provided by a wire bar, passed through a dryer having the temperature of 50° C. for 2 minutes for drying to thereby form a back layer A.

[Back Layer Coating Liquid A]

| | |
|---|---|
| Acrylamide core-shell resin having a glass transition temperature of 200° C. (B1000, manufactured by Mitsui Chemicals, Inc.) | 75 parts |
| Water | 25 parts |

Example 12

A thermosensitive recording medium of Example 12 was prepared in the same manner as in Example 11, provided that a back layer B was formed by using a back layer coating liquid B in which the following particles are added to the back layer coating liquid A.

| | |
|---|---|
| Polymethyl methacrylate spherical particles (MX-1000, manufactured by Soken Chemical & Engineering Co., Ltd., volume average particle diameter: 10 μm) | 0.02 parts |
| Polymethyl methacrylate spherical particles (MA-1006, manufactured by NIPPON SHOKUBAI CO., LTD., volume average particle diameter: 6 μm) | 0.2 parts |

Example 13

A thermosensitive recording medium of Example 13 was prepared in the same manner as in Example 12, provided that a back layer C was formed by using a back layer coating liquid C in which 30 parts of SA-101 (CHEMISTAT SA-101, manufactured by Sanyo Chemical Industries, Ltd.) was added to the back layer coating liquid B as an antistatic agent.

Example 14

A thermosensitive recording medium of Example 14 was prepared in the same manner as in Example 13, provided that 10 parts of urethane acrylate-based conductive polymer (U601PA, manufactured by Shin-Nakamura Chemical Co., Ltd.) was further added to the surface layer coating liquid to form a surface layer.

Example 15

A thermosensitive recording medium of Example 15 was prepared in the same manner as in Example 14, provided that 5 parts of hexamethylene bishydroxystearic acid amide (Slipax ZHH, manufactured by Nippon Kasei Chemical Co., Ltd.) was added instead of zinc stearate to the surface layer coating liquid to form a surface layer.

Comparative Example 1

A thermosensitive recording medium of Comparative Example 1 was prepared in the same manner as in Example 1, provided that tri-functional polyester acrylate (ARONIX M-8060, manufactured by TOAGOSEI CO., LTD.) contained in the surface layer coating liquid of the surface layer A was replaced with tri-functional isocyanuric acid acrylate (ARONIX M-325, manufactured by TOAGOSEI CO., LTD.).

Comparative Example 2

A thermosensitive recording medium of Comparative Example 2 was prepared in the same manner as in Example 1, provided that α-hydroxyketone-based polymerization initiator (IRGACURE 184, manufactured by BASF Japan Ltd. melting point: 45° C. to 49° C.) was added instead of IRGACURE 127, the polymerization initiator used in Example 1, to the surface layer coating liquid of the surface layer A, to thereby form a surface layer G.

Comparative Example 3

A thermosensitive recording medium of Comparative Example 3 was prepared in the same manner as in Example 1, provided that instead of the polymerization initiator IRGACURE 127, α-amino ketone-based polymerization initiator (IRGACURE 907, manufactured by BASF Japan Ltd., melting point: 82° C. to 87° C.) was added to the surface layer coating liquid to form a surface layer.

Comparative Example 4

A thermosensitive recording medium of Comparative Example 4 was prepared in the same manner as in Example 1, provided that instead of tri-functional polyester acrylate (ARONIX M8060, manufactured by TOAGOSEI CO., LTD.), bifunctional polyester acrylate (M6500, manufactured by TOAGOSEI CO., LTD.) was added to the surface layer coating liquid to form a surface layer.

Comparative Example 5

A thermosensitive recording medium of Comparative Example 5 was prepared in the same manner as in Example 1, provided that instead of the polymerization initiator IRGACURE 127, acyl phosphonoxide-based polymerization initiator (IRGACURE 819, BASF Japan Ltd., melting point: 127° C. to 133° C.) was added to the surface layer coating liquid.

The prepared thermosensitive recording mediums of Examples and Comparative Examples were evaluated in terms of its surface glossiness, film odor, depositions to a head, yellowing, sticking, curling, film transporting property, and charging, in the following manners. The results are shown in Table 1.

(1) Glossiness

A surface glossiness was measured at 75° by means of a gloss meter (Model 1001DP) manufactured by NIPPON DENSHOKU INDUSTRIES CO., LTD. The higher the value is the higher glossiness is.

(2) Film Odor

Ten coated films were placed in a plastic bag, and odor of the film was evaluated in accordance with the following criteria by organoleptic evaluation.

[Evaluation Criteria]

5: No odor was confirmed.
4: Slight odor was confirmed.
3: Some odor was confirmed.
2: Strong odor was confirmed.
1: Strong irritating odor was confirmed, which was uncomfortable.

(3) Depositions to Head

A pattern a half of which had an imaging ratio of 100% in the width direction, and another half of which had an imaging ratio of 0% was formed by an energy-variable HORIZON (manufactured by Codonics Inc.) equipped with a gradation head having a resolution of 300 dpi, and printed in the size of A4 on 50 pieces. Thereafter, the thermal head was observed under a microscope whether there were any depositions on the thermal head, and evaluated based on the following criteria.

5: No deposition was found on the thermal head.
4: A slight amount of depositions was observed on the thermal head, but it did not adversely affect the resulting image, and the depositions could be easily removed by wiping.
3: Depositions were observed on the thermal head, but it did not adversely affect the resulting image, and the depositions could be easily removed by wiping.
2: Depositions were observed on the thermal head, affected the resulting image, and could not be removed unless an abrasive composition or the like was used.
1: A large amount of depositions was observed on the thermal head, adversely affected the resulting image, and could not be removed unless an abrasive composition or the like was used.

(4) Yellowing

A color tone of the background of the sample was measured with b-value by a transmission densitometer TD-904, manufactured by GretagMacbeth, and the measured values were evaluated based upon the following criteria. Note that, the larger the value is more significant yellowing is, and the closer to "0" the value is the whiter the color is.

[Evaluation Criteria]

A: The b-value was less than ±0.5.
B: The b-value was ±0.5 or more but less than ±1.5.
C: The b-value was ±1.5 or more but less than ±2.5.
D: The b-value was ±2.5 or more.

(5) Sticking

A pattern in which a gradation was provided along with the direction of the movement of an A4 film was printed on the film by means of HORIZON (manufactured by Codonics Inc.) equipped with a gradation head having resolution of 300 dpi. The length of the image was measured by the first-class carpenter's square designated by JIS, and evaluated based on the following criteria.

[Evaluation Criteria]

5: The printed image length was the same as that of the standard.
4: The printed image length was shorter than the standard by 0 mm or more, but less than 0.5 mm.
3: The printed image length was shorter than the standard by 0.5 mm or more but less than 1 mm.
2: The printed image length was shorter than the standard by 1 mm or more but less than 2 mm.
1: The printed image length was shorter than the standard by 2 mm or more.

(6) Curling

The thermosensitive recording medium was cut into a size of A4, and the sized thermosensitive recording medium was placed on a flat table with the thermosensitive recording side up. The heights of the lifted four corners of the placed thermosensitive recording medium were each measured, the maximum value thereof was taken as a measurement value, and evaluated based on the following criteria.

[Evaluation Criteria]

A: The curling value was 2 mm or less.

B: The curling value was 3 mm to 5 mm.

C: The curling value was 6 mm to 10 mm.

D: The curling value was 10 mm or more.

(7) Film Transferring Ability

A sample of the thermosensitive recording medium was cut into the size of A4, and two sized samples were laminated. Then, a test pattern was printed by means of HORIZON (manufactured by Codonics Inc.). The transferring ability of the film was evaluated in terms of double feeding, after printing the test pattern on one piece of the samples.

[Evaluation Criteria]

A: The film was transferred without any problem.

B: The underlying film was fed together until the half way of the printing on the film.

C: The both films were double fed completely, and then printed, or the transfer error occurred in the half way of the procedure.

(8) Charging

An evaluation image was continuously printed in the A4 size on three pieces of the thermosensitive recording medium by means of HORIZON (manufactured by Codonics Inc.) under the low temperature low humidity environment, i.e. 10° C. and 10% RH. The charge of the thermosensitive recording medium at the time the medium was discharged was measured by means of Electric Field Meter, Model No. 19445, manufactured by Desco Industries, Ino., and evaluated based on the following criteria.

[Evaluation Criteria]

A: The charge was less than ±0.5 kV.

B: The charge was ±0.5 kV or more but less than ±1.0 kV.

C: The charge was ±1 kV or more but less than ±5 kV.

D: The charge was ±5 kV or more.

TABLE 1

| | Glossiness | Odor | Head dust | Yellowing | Sticking | Curing | Film transferring | Charging |
|---|---|---|---|---|---|---|---|---|
| Ex. 1 | 93% | 5 | 3 | B | 3 | C | B | C |
| Ex. 2 | 93% | 5 | 3 | B | 4 | C | B | C |
| Ex. 3 | 95% | 5 | 4 | B | 3 | C | B | C |
| Ex. 4 | 95% | 5 | 4 | B | 3 | C | B | C |
| Ex. 5 | 95% | 5 | 4 | B | 3 | C | B | C |
| Ex. 6 | 90% | 5 | 5 | B | 4 | C | B | C |
| Ex. 7 | 90% | 5 | 5 | B | 4 | C | B | C |
| Ex. 8 | 90% | 5 | 5 | A | 4 | C | B | C |
| Ex. 9 | 90% | 5 | 5 | A | 4 | C | B | C |
| Ex. 10 | 90% | 5 | 5 | A | 4 | C | B | C |
| Ex. 11 | 90% | 5 | 5 | A | 4 | A | B | C |
| Ex. 12 | 90% | 5 | 5 | A | 4 | A | A | C |
| Ex. 13 | 90% | 5 | 5 | A | 4 | A | A | B |
| Ex. 14 | 90% | 5 | 5 | A | 4 | A | A | A |
| Ex. 15 | 90% | 5 | 5 | A | 5 | A | A | A |
| Comp. Ex. 1 | 93% | 4 | 3 | B | 2 | C | B | C |
| Comp. Ex. 2 | 93% | 2 | 2 | B | 3 | C | B | C |
| Comp. Ex. 3 | 93% | 3 | 3 | D | 3 | C | B | C |
| Comp. Ex. 4 | 93% | 2 | 2 | B | 2 | C | B | C |
| Comp. Ex. 5 | 93% | 2 | 5 | D | 3 | C | B | C |

From the results shown in Table 1, it is clear that, compared to the thermosensitive recording mediums of Comparative Examples 1 to 5, the thermosensitive recording mediums of Examples 1 and 2 can be used as a medical recording medium of high gradation, having excellent properties such as no odor, no deposition to a head, and suppressed yellowing of the back ground.

Moreover, the thermosensitive recording mediums of Examples 3 to 5 has the excellent effect for preventing the deposition to the head by using the α-hydroxyketone-based initiator and the acylphosphoneoxide-based initiator in combination.

Furthermore, the thermosensitive recording medium of Example 6 gives hardly any deposition to the head as a result of the addition of the filler to the surface layer.

The thermosensitive recording medium of Example 7 has the further improved effect for prevention of sticking as a result of the addition of organosiloxane polyether to the surface layer.

The thermosensitive recording medium of Example 8 obtained a sufficiently cured film with irradiation energy of 100 mj/cm$^2$ by providing an atmosphere of 0.5% oxygen concentration during the irradiation of ultraviolet rays for the surface layer, and as a result, yellowing of the back ground could be prevented while maintaining other properties, such as preventing odor and depositions to a head.

The thermosensitive recording medium of Example 9 could prevent yellowing of the back ground, which would be caused by irradiation of ultraviolet rays, by adding the ultraviolet absorber to the intermediate layer.

The thermosensitive recording medium of Example 10 enhanced whiteness of the color tone of the back ground because the fluorescent dye was added to the intermediate layer.

The thermosensitive recording medium of Example 11 reduced curling of the medium and improved its handling ability because the back layer was provided.

The thermosensitive recording medium of Example 12 reduced occurrences of sticking between the mediums because the filler was added to the back layer.

The thermosensitive recording mediums of Examples 13 and 14 reduced the charging during printing because the antistatic agent was added to the back layer and the surface layer, and as a result the handling ability thereof after printing was improved. Moreover, since fatty acid amide was added to the surface layer, the charging amount was reduced, which gave the effect of reducing the possibility for damaging a head due to transferring of the medium during printing or the charged medium.

What is claimed is:

1. A thermosensitive recording medium, comprising:

a support;

a thermosensitive recording layer; and a surface layer, where the thermosensitive recording layer and the surface layer are provided over the support, wherein the thermosensitive recording layer contains a binding agent, a coloring agent, and a color developer, and wherein the surface layer contains polyester (meth)acrylate having at least three (meth)acryloyl groups, and an α-hydroxyketone-based polymerization initiator having a melting point of 80° C. or higher.

2. The thermosensitive recording medium according to claim 1, wherein the surface layer further contains an acyl phosphinoxide-based polymerization initiator.

3. The thermosensitive recording medium according to claim 1, wherein the surface layer further contains filler, a lubricant, or both thereof.

4. The thermosensitive recording medium according to claim 1, wherein the surface layer further contains a polyorganosiloxane-polyether copolymer.

5. The thermosensitive recording medium according to claim 1, wherein the surface layer is formed by ultraviolet irradiation which is performed with an oxygen concentration of 0.1% to 1%, and ultraviolet irradiation intensity of 50 $mJ/cm^2$ to 200 $mJ/cm^2$.

6. The thermosensitive recording medium according to claim 1, further comprising an intermediate layer provided between the thermosensitive recording layer and the surface layer, wherein the intermediate layer contains a water-soluble resin, water-dispersible resin, or both thereof.

7. The thermosensitive recording medium according to claim 6, wherein the thermosensitive recording layer, the intermediate layer, or both thereof contain an ultraviolet absorber.

8. The thermosensitive recording medium according to claim 6, wherein at least one layer selected from the group consisting of the thermosensitive recording layer, the intermediate layer, and the surface layer contains a fluorescent dye.

9. The thermosensitive recording medium according to claim 1, further comprising a back layer provided on a surface of the support opposite to the surface thereof where the thermosensitive recording layer is provided, wherein the back layer contains a binder.

10. The thermosensitive recording medium according to claim 9, wherein the back layer further contains filler.

11. The thermosensitive recording medium according to claim 9, wherein the back layer further contains an antistatic agent.

12. The thermosensitive recording medium according to claim 9, wherein the back layer, the surface layer, or both thereof further contain an antistatic agent.

13. The thermosensitive recording medium according to claim 1, wherein the surface layer further contains fatty acid amide.

* * * * *